US006908108B1

(12) United States Patent
Scarla

(10) Patent No.: US 6,908,108 B1
(45) Date of Patent: Jun. 21, 2005

(54) ROLL CAGE

(76) Inventor: Robert Scarla, 7311 E. Sunnyside, Scottsdale, AZ (US) 85260

( * ) Notice: Subject to any disclaimer, the term of this patent is extended or adjusted under 35 U.S.C. 154(b) by 18 days.

(21) Appl. No.: 10/426,101

(22) Filed: Apr. 28, 2003

(51) Int. Cl.[7] ..... B60R 21/13
(52) U.S. Cl. ..... 280/756
(58) Field of Search ..... 280/756; 296/203.1, 296/205; 446/470

(56) References Cited

U.S. PATENT DOCUMENTS 1,578,594 A * 3/1926 Florkey ..... 446/470
3,583,095 A 6/1971 Fahrendorff
4,767,376 A 8/1988 Hanzawa
5,259,808 A 11/1993 Garr
5,401,056 A * 3/1995 Eastman ..... 280/785
5,449,311 A 9/1995 Williams
5,643,036 A 7/1997 Liu
5,718,454 A 2/1998 Harrod
5,725,270 A * 3/1998 Fleishman ..... 296/181.1
5,931,524 A * 8/1999 Jones, Jr. ..... 296/177
6,508,320 B2 1/2003 Huntsberger

* cited by examiner

*Primary Examiner*—Faye M. Fleming
(74) *Attorney, Agent, or Firm*—LaValle D. Ptak

(57) ABSTRACT

A roll cage for a model car or truck is made of first and second elongated members and first and second inverted U-shaped cross members fabricated from flat metal stock. The roll cage is assembled by slip-fitting it together at mating slots formed into the elongated roll cage members and the inverted U-shaped roll cage members. A rigid roll cage is formed, which then is attached to the chassis of the model car or truck to overlie the components mounted on that chassis.

19 Claims, 6 Drawing Sheets

ROLL CAGE

BACKGROUND

Substantial interest has developed in the operation and competitive racing of radio controlled, gasoline and electric powered model automobiles and trucks of relatively sophisticated design. These model trucks and automobiles use small, high performance gasoline and engines and include transmissions, radio controlled power steering mechanisms and sophisticated suspension systems. The models typically are between two and three feet in length, with proportionate width, and generally have a plastic "body" cover mounted over the operating components on the chassis of the model. Typically, the plastic body, which provides the overall esthetic appearance, of the model is mounted at the front and rear onto shock absorber towers for the front and rear wheels.

Gasoline and electric powered radio controlled model automobiles and trucks of the general type described above are capable of being operated at relatively high speeds, on the order of 40 MPH, or more. In addition, by utilizing relatively large wheels (compared to the size of the overall chassis), the models are designed to be operated over relatively rough, rugged, rocky terrain, if desired. When the models are raced against one another, or when they are operated over rough terrain, they occasionally roll over. When this occurs, the plastic body cover undergoes considerable stress, and often the body cover is damaged. In addition, the common mounting of the body cover to the shock absorber towers may result in breaking of the towers in a rollover, since typically they also are made of plastic. If the body cover, which is a relatively weak, lightweight component, is crushed or broken away, the operating components of the model attached to the underlying chassis also may be subjected to damage by contact with the ground in the event of a rollover.

The United States patent to Fahrendorff U.S. Pat. No. 3,583,095 discloses a toy vehicle which has a roll bar attached to the frame, near the rear of the vehicle. A top for the vehicle has parts which extend through portions of the underlying vehicle with tabs at the front, and then is clipped onto the roll bar at the rear. The vehicle, however, is not a radio controlled model car or truck; and the roll bar simply serves as a connecting member for attaching clips on the underside of the top to securely hold the top on the body. As mentioned in this patent, the interconnection of the top with the roll bar is maintained with sufficient force to allow the toy to be picked up solely by its top in normal play by children. The roll bar essentially is in the form of an inverted U-shaped solid, cylindrical rod.

The United States patent to Harrod U.S. Pat. No. 5,718,454 discloses a child's ride-on vehicle, which has an open top and which has a tubular roll bar attached across the rear of the toy around the seat.

It is desirable to provide a roll cage for gasoline and electric powered, radio-controlled model automobiles and trucks which is simple to manufacture and install, and which provides rollover protection for components mounted on the chassis of the model.

SUMMARY OF THE INVENTION

It is an object of this invention to provide an improved roll cage for a model car or truck.

It is another object of this invention to provide an improved easy to assemble roll cage for a model car or truck.

It is an additional object of this invention to provide an improved roll cage made of flat stock for a model car or truck.

It is a further object of this invention to provide an improved flat stock metal roll cage for supporting the body and protecting the operating components of a model car or truck.

In accordance with a preferred embodiment of the invention, a roll cage for a model car or truck having an elongated chassis carrying the operating components of the model car or truck comprises at least one elongated roll cage member configured to substantially overlie the length of the chassis over operating components on the chassis. At least one generally inverted U-shaped roll cage member is configured to substantially overlie the width of the chassis, with the bight portion of the inverted U-shaped roll cage member located over operating components on the chassis. The elongated roll cage member and the inverted U-shaped roll cage member are interconnected at the bight portion of the U-shaped roll cage member; and the roll cage is attached to the chassis of the model car or truck.

DETAILED DESCRIPTION

Figure 1:
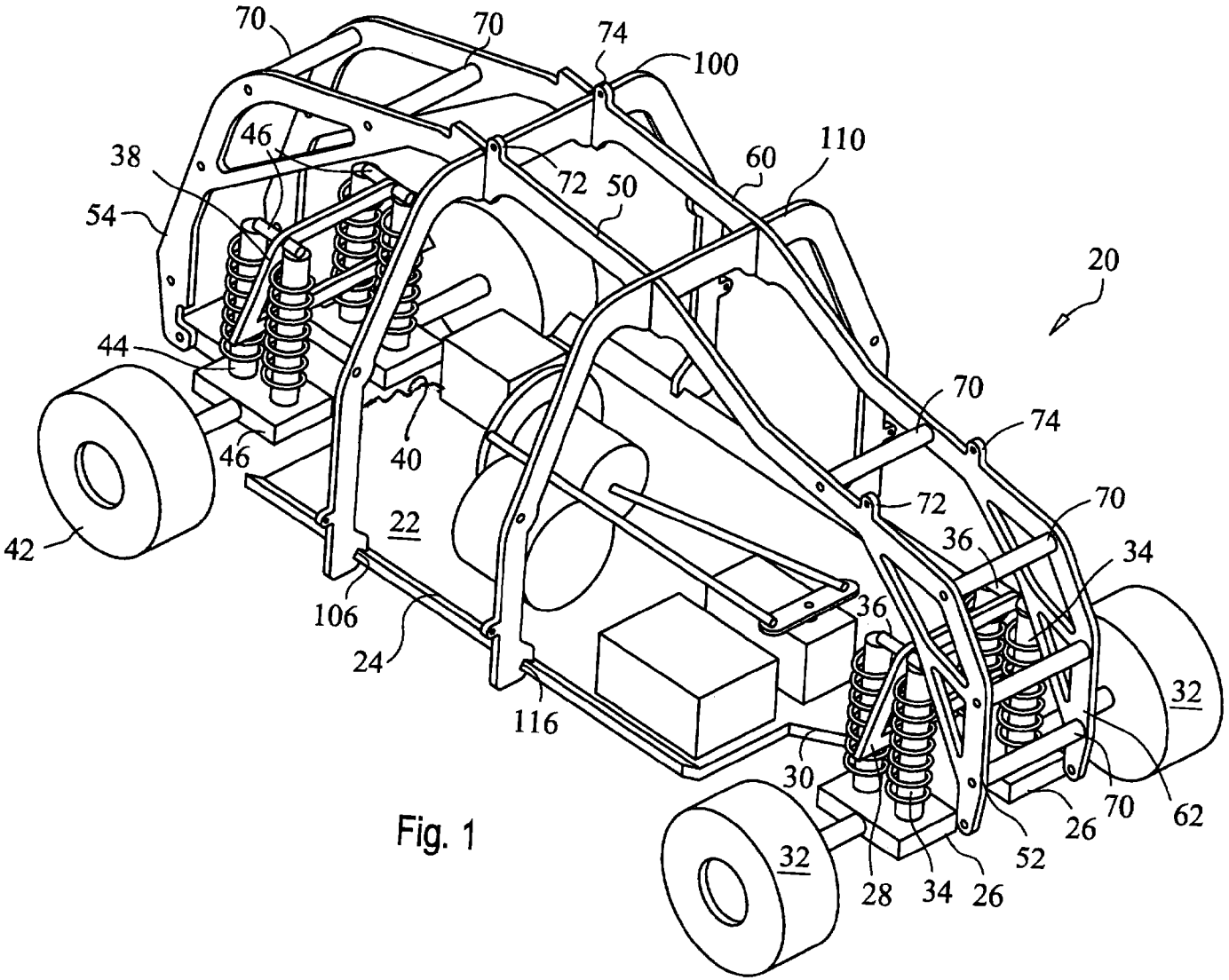
FIG. 1 is a top front perspective view of a preferred embodiment of the invention mounted on a model car.

Reference now should be made to the drawing, in which the same reference numbers are used throughout the different figures to designate the same or similar components. FIG. 1 is a top perspective view of a model car or truck chassis to which a preferred embodiment of the invention has been mounted or attached. The model car 20 of FIG. 1 is diagrammatically illustrated; and the actual detailed physical interconnections of various parts of the model car which are not necessary for an understanding of the present invention are show only in diagrammatic form.

Basically, the model car 20 which is shown in FIG. 1 is a radio-controlled (RC) gasoline or electric powered model car of a generally conventional design. The car 20 includes a chassis plate 22, which either may be an original equipment chassis plate or one which is provided as a modification to the original model car kit.

As illustrated in FIG. 1, the chassis plate 22 has slightly upturned longitudinal edges 24 on each side of the plate 22. Various operating components (not numbered) for the model car, including the gasoline engine, exhaust system, gasoline tank or battery, RC receiver, steering control, and other components, are mounted on top of the chassis 22. Some of these components are represented in FIG. 1 on the chassis 22. These components operate in a standard manner to provide the operation of the car; and these components are not important for an understanding of the present invention directed to a roll cage.

To provide an orientation for the various parts, however, details of some of the car components ate diagrammatically illustrated in FIG. 1. The front and rear of the chassis 22 includes extensions 30 and 40 (extension 40 is shown partially broken away) for supporting combined shock absorber towers and bump-stop elements 28 and 38 on the front and rear ends of the chassis respectively. The manner in which these shock absorber towers 28 and 38 are connected to the chassis 22 is conventional; and the details are not illustrated in FIG. 1.

As diagrammatically illustrated in FIG. 1, independent suspension is provided for the two front wheels 32 and the two rear wheels 42, which are shown as carried by front support members 26 and rear support members 46, respectively. Again, it should be noted that these elements are only diagrammatically represented, and that in a typical assembly this independent suspension will involve automobile-like interconnections of pivoted wheels and axle assemblies, along with appropriate ball joints, steering tie rods and the like for the front wheels 32, and transmission connections for the rear wheels 42 (and for a four wheel drive, the front wheels 32 as well). These details are not shown, since to do this would unnecessarily clutter the drawing with components that form no part of the present invention. The supports 26 and 46 are mounted through shock absorbers 34 in the front and 44 in the rear to the shock towers 28 and 38, respectively, through spacers 36 (in the front) and 46 (in the rear) attached to the shock towers 28 and 38, as diagrammatically illustrated in FIG. 1.

As shown in FIG. 1, a completed roll cage assembly extends over all of the components described above. This roll cage assembly includes two spaced-apart elongated roll cage members 50 and 60, which extend generally parallel to one another longitudinally of the length of the chassis 22, and overlie the operating components on the chassis 22 and the front and rear wheel assemblies as well.

Figure 9:
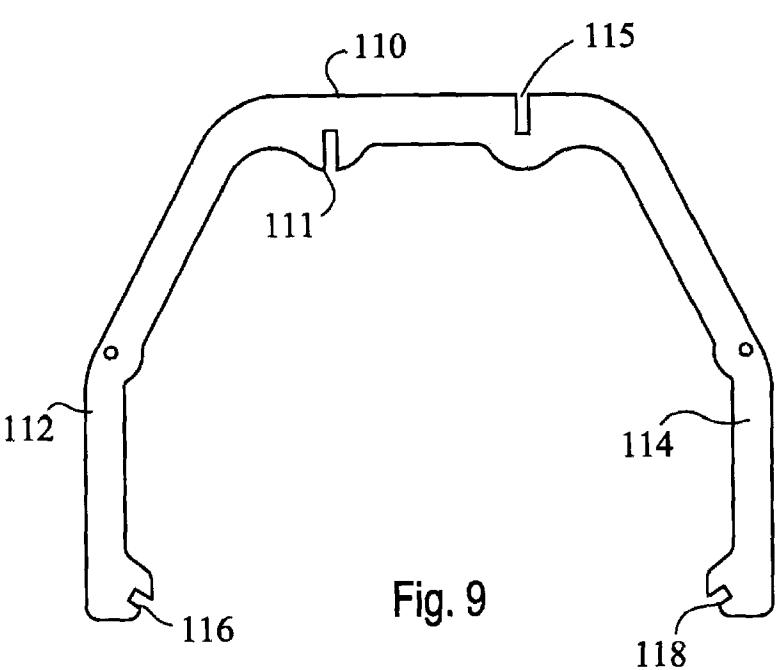
FIGS. 8 and 9 are side views of alternative components to the ones shown in FIGS. 2 and 3.
Figure 8:
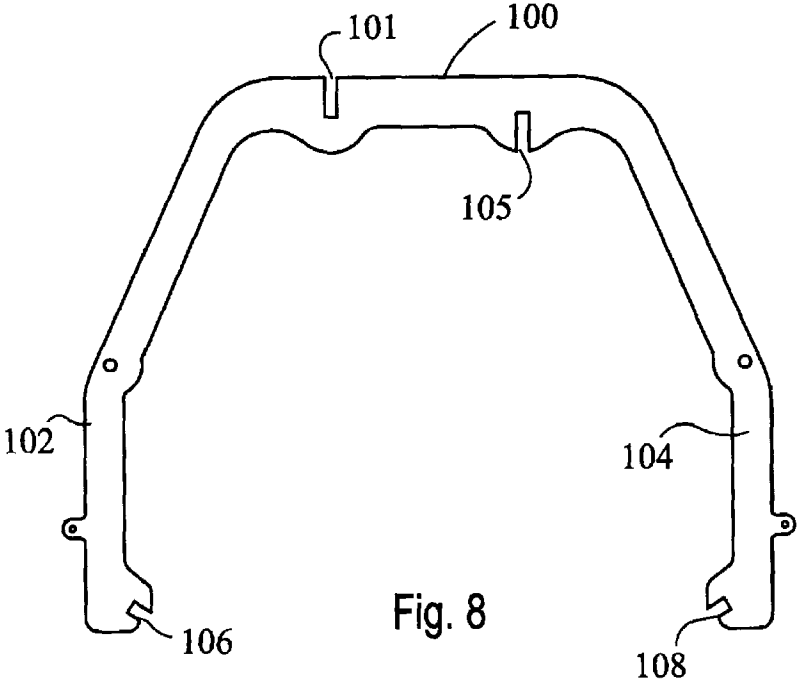

These elongated longitudinally oriented roll cage members 50 and 60 are supported on a pair of generally inverted U-shaped transverse roll cage members 100 and 110, which extend across the width of the chassis 22, and which are spring-fit onto the upturned edges 24 on opposite sides of the chassis 22 through slots 106 and 108 on the member 100, and slots 116 and 118 on the member 110, as most clearly shown in FIGS. 8 and 9.

The elongated longitudinally oriented roll cage members 50 and 60 are spaced apart at their forward and remote ends by means of spacer bars 70, six of which are illustrated in FIG. 1. Similar spacer bars also may be provided between the ends of the transverse roll cage members 100 and 110, in a similar fashion; although such spacer bars have not been shown in FIG. 1, again to avoid cluttering of the drawing.

It should be noted that model cars and trucks of the type generally described above are provided with a molded plastic body or cover, which provides the esthetic appearance of the design of the car or truck. The underside of such a plastic body conforms with the upper surface of the roll cage members 50,60,100 and 110; so that firm support for this body (not shown) is provided throughout its length and width. Thus, in the event of a rollover, the plastic body is not crushed but is supported by the roll cage 50,60,100,110.

Connection of the plastic body to the roll cage readily may be effected by providing openings through the body which correspond to projections 72,74 spaced apart on the elongated roll cage members 50 and 60 and similar projections near the lower ends of the transversely located inverted U-shaped roll cage members 100 and 110. These projections are provided with holes through them to permit body clips or locking pins to be placed through the holes above the plastic body to removably hold it in place on the roll cage.

Figure 3:
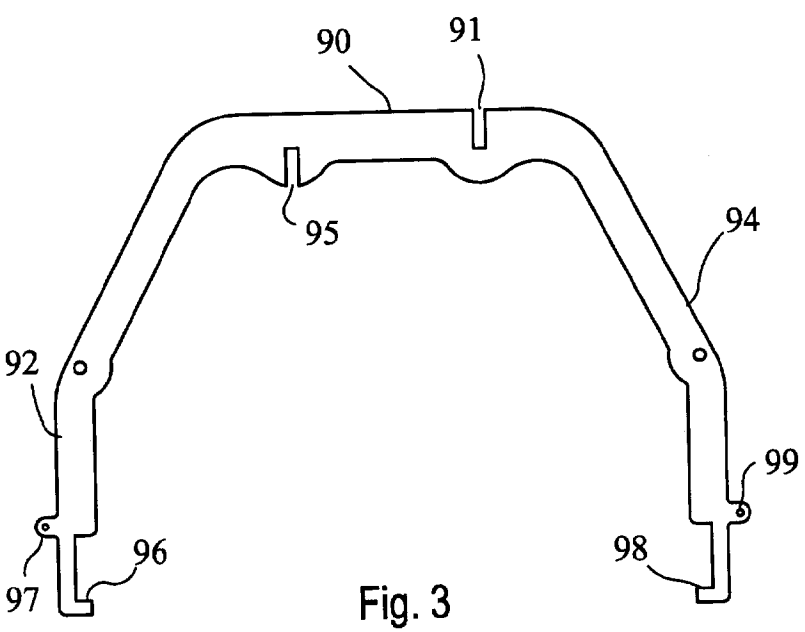
FIGS. 2, 3, 4 and 5 are side views of components of the embodiment shown in FIG. 1.
Figure 2:
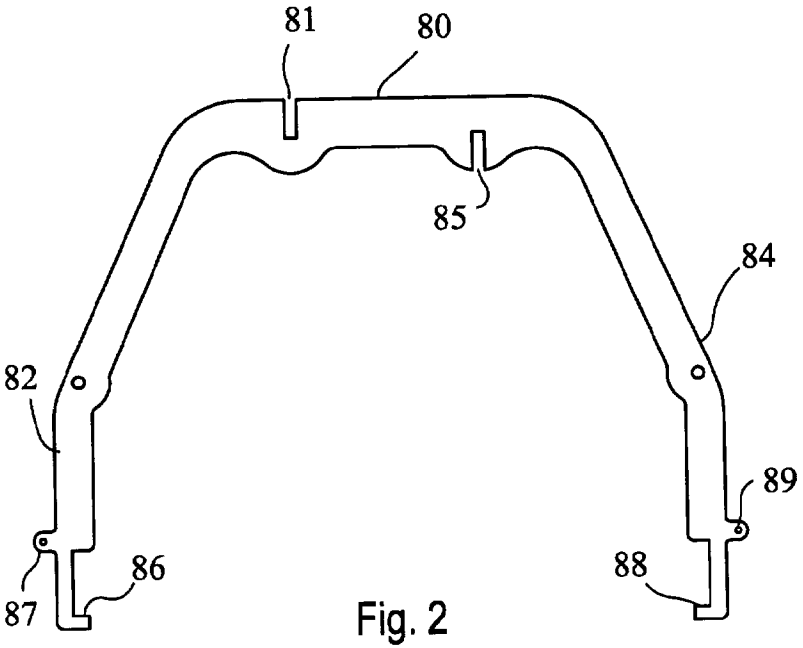
Figure 4:
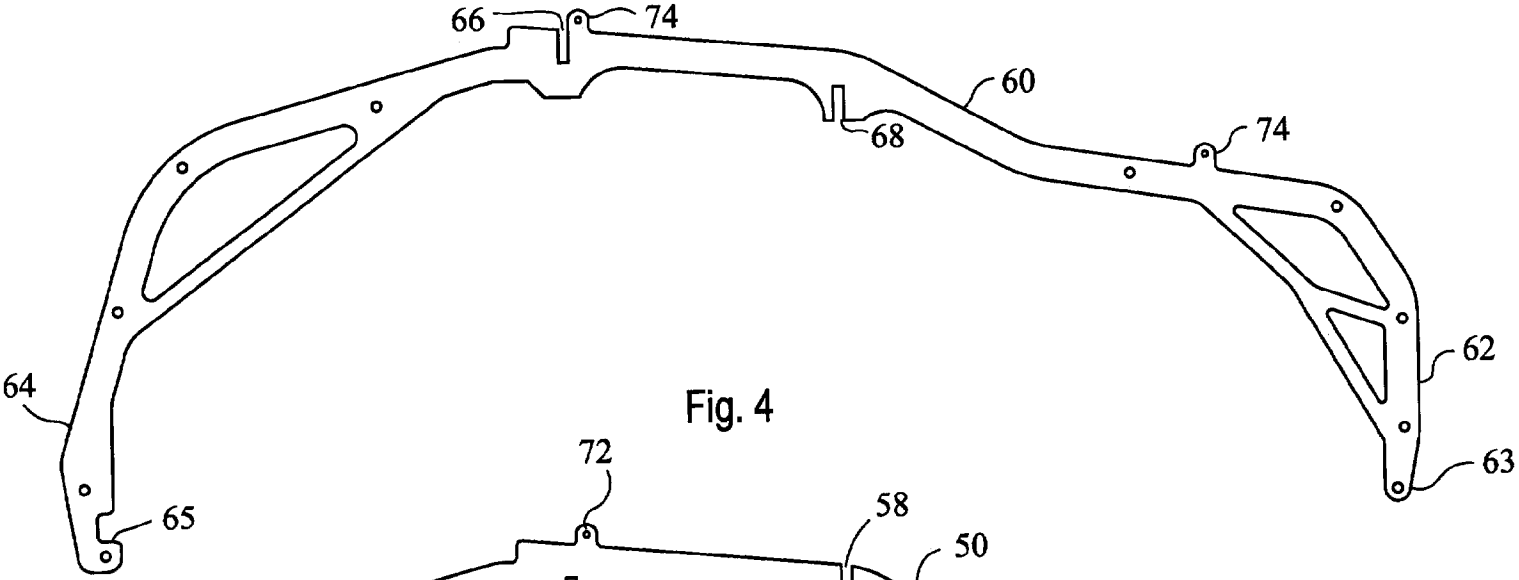
Figure 5:
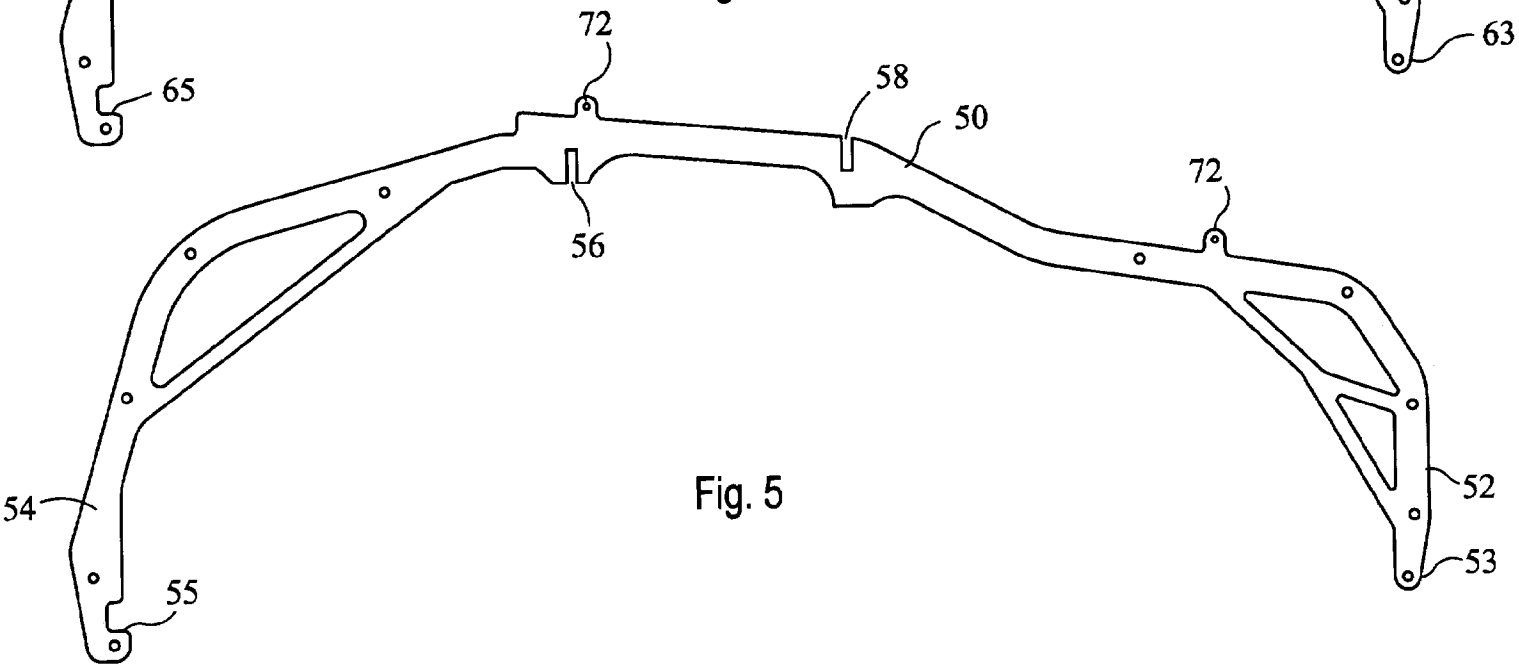

The roll cage, shown assembled on the model car or truck 20 of FIG. 1, employs the elongated roll cage members 50 and 60 shown in FIGS. 4 and 5, and the transverse members 100 and 110 shown in FIGS. 8 and 9. An alternative to the inverted U-shaped transverse roll cage members shown in FIGS. 8 and 9 is illustrated in FIGS. 2 and 3.

As illustrated in FIGS. 4 and 5, the elongated or longitudinal roll cage members 50 and 60 are of substantially identical configuration, and are designed to be spaced apart by the spacer bars 70 in the manner shown in FIG. 1. These roll cage members include forward down turned ends 52 and 62, respectively, with rear down turned ends 54 and 64, respectively, (as shown most clearly in FIGS. 4 and 5), the orientation of which is illustrated in FIG. 1. As mentioned above, the upper edges of the roll cage members 50 and 60 are designed to closely underlie the plastic body designed to be attached to the roll cage members 50 and 60. Obviously, for different body designs the configuration of this surface of the members 50 and 60 can be varied to accommodate different shapes of plastic bodies to be attached to the roll cage members.

The upwardly extending projections 72 on the member 50 and 74 on the member 60 are designed to be extended through holes or apertures in a plastic body to allow cotter pins or body clips to be inserted through the holes in these members over the body, which is then held in tight engagement with the upper surface of the elongated members 50 and 60. The lowermost ends 53 and 55 of the member 50 and 63 and 65 of the member 60 are configured to extend downwardly adjacent to or slightly above the members 26 and 46 illustrated in FIG. 1. In the embodiment shown in FIG. 1, there is no interconnection of the ends 53,63,55 and 65 with any part of the chassis; and these components simply extend over and protect the wheel mounts and shock towers of the model.

As shown in FIGS. 8 and 9, the inverted U-shaped transverse members 100 and 110 include downwardly extending legs 102 and 104 for the member 100, and 112 and 114 for the member 110. These legs extend downwardly from the bight of the inverted U-shaped transverse members. Each of these members terminates, as described previously, at the lower end of the legs in angled slots 106/108 for the member 110, and 116/118 for the member 110. Again as described previously, these slots engage the upturned edge 24 of the chassis 22 to clamp the members 100 and 110 firmly in place on the edge of the chassis 22.

Figure 6:
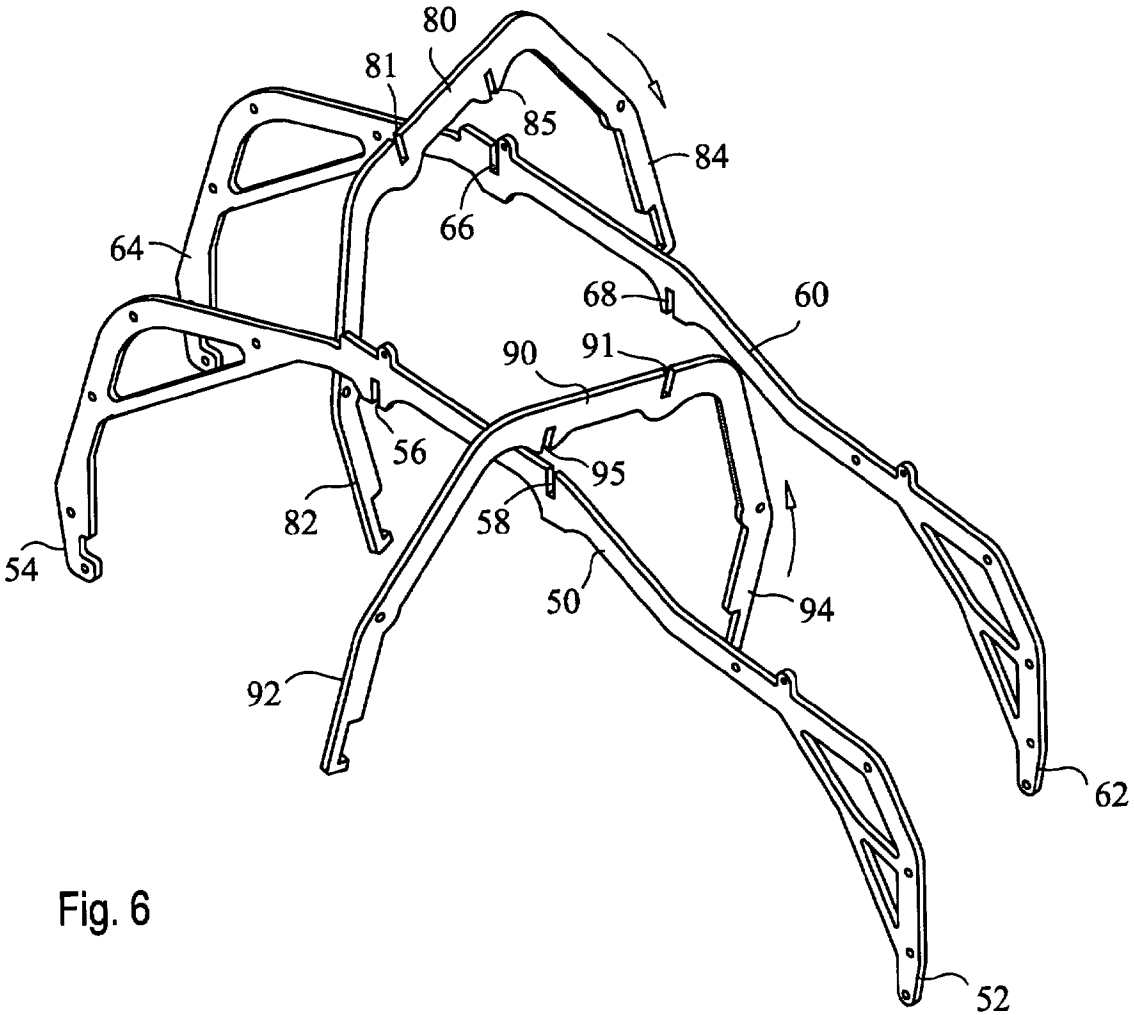
FIG. 6 is a diagrammatic perspective view of the components of FIGS. 2, 3, 4 and 5 illustrating the manner of assembly of these components.
Figure 7:
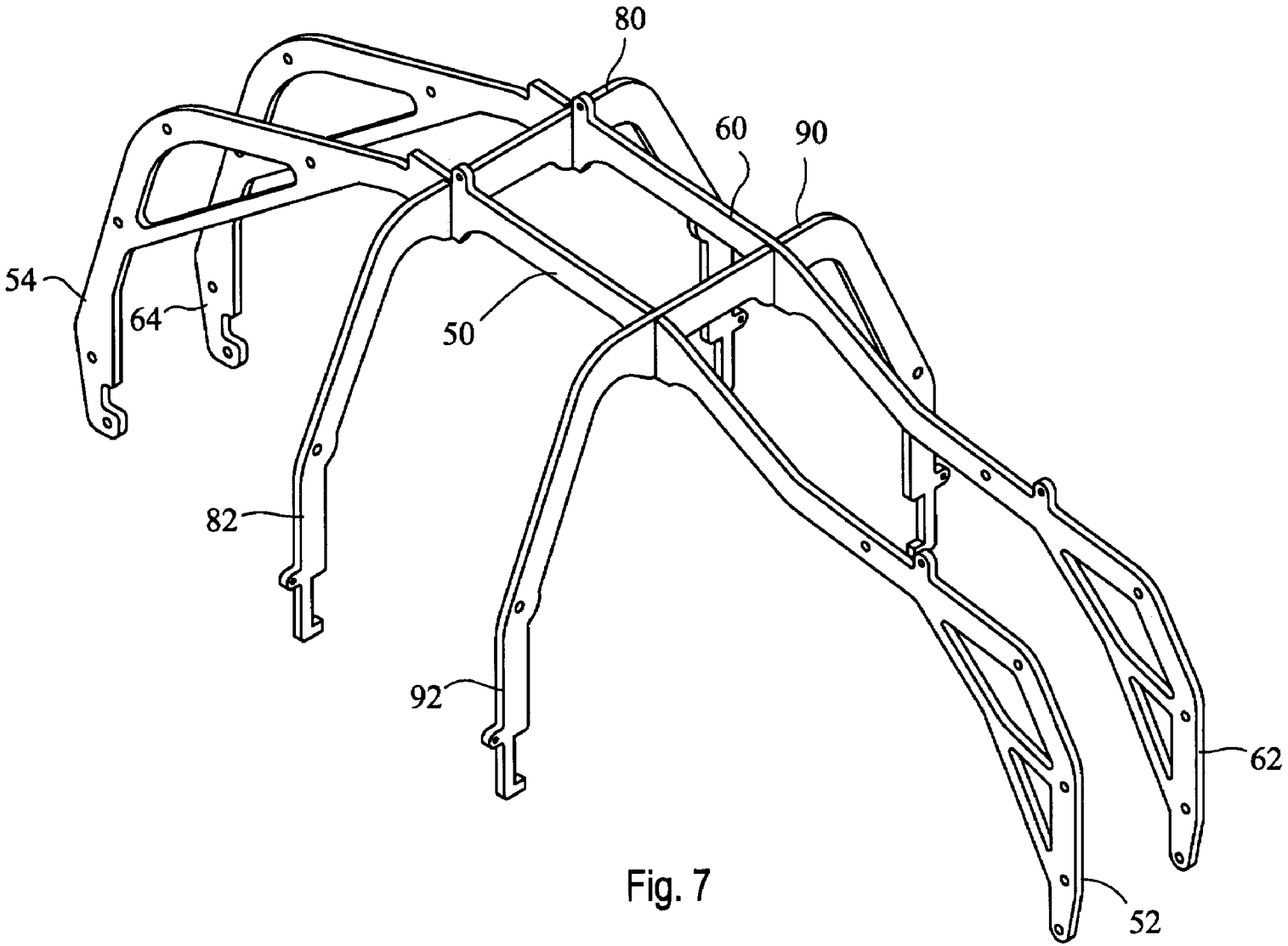
FIG. 7 is a top perspective view of the fully assembled components of FIG. 6.

As is most clear from an examination of FIGS. 1, 6 and 7, all of the components forming the roll cage 50,60,100,110 (and in an alternative embodiment, 80 and 90) are made of flat stock, preferably of metal such as steel or aluminum. The assembly of the roll cage is effected without requiring any fasteners or welding or brazing, by means of alternating mating slots 56 and 58 on the member 50, 66 and 68 on the member 60. These slots are designed to be engaged with corresponding slots on the members 100 and 110, namely the slots 101,105 and 111 and 115.

As shown in FIGS. 2 and 3, an alternative configuration of the members 100 and 110 is illustrated, which is identical to the members of FIGS. 8 and 9 with the exception of the termination at the lower ends of these members. The inverted U-shaped roll cage members 80 and 90 shown in FIGS. 2 and 3 include downwardly depending arms 82 and 84 for the member 80 and 92 and 94 for the member 90. These arms extend downwardly from the bight of the U-shaped cross members and terminate in hook shaped terminations 86 and 88 for the member 80 and 96 and 98 for the member 90. Also shown in FIGS. 2 and 3 are projections 87,89,97 and 99, which extend through the plastic car body, described above, to allow it to be clipped into place in conjunction with the projections 72 and 74 for the members 50 and 60.

The roll cage assembly is effected without any fasteners, welding or brazing being necessary. As shown in FIG. 6, this is accomplished by slip-fitting mating slots 56,58,66,68 on the members 50 and 60 with slots 81,85 and 91,95 on the members 80 and 90 in the manner generally indicated in FIG. 6. The components are aligned as illustrated in FIG. 6; and then the transverse U-shaped roll cage members 80 and 90 are rotated in the direction of the arrows shown in FIG. 6 to inter-engage the upwardly facing slot 81 on the member 80 with the downwardly facing slot 56 on the member 50, and the downwardly facing slot 85 on the member 80 with the upwardly facing slot 66 on the member 60. Similarly, rotation of the transverse U-shaped member 90 is made to inter-engage the slots 95 and 58, as shown in FIG. 6, and the slots 91 and 68 to form the completed roll cage assembly, as illustrated in FIG. 7.

It should be noted that the slots are formed substantially half way through the width dimensions of all of the various members 50,60,80 and 90 (and member 100 and 110) to provide the integrated friction-fit assembly shown in FIG. 7. When steel or aluminum parts are used for the material of the roll cage members, the tight fitting inter-engaged slots shown in FIGS. 2, 3, 4, 5 and illustrated in the assembly drawing of FIG. 7 cause a very rigid assembly to take place. When the spacer bars 70 described above in conjunction with FIG. 1 are added, the assembly is quite strong.

With the assembled roll cage shown in FIG. 7, the downward projecting hook-like ends 86,88 and 96,98 may be extended through holes or apertures in the chassis 22 to then engage the edges of the chassis. Similarly, these hooks could be extended over the edge of a flat chassis 22 (not illustrated) by forcing outwardly, against spring tension, the lower ends of the members 80 and 90 to then allow them to snap back under spring tension and grip the chassis or an aperture in the edge of the chassis, depending upon how the roll cage is to be attached to such a chassis.

FIGS. 8 and 9, illustrated in conjunction with FIG. 1, include transverse inverted U-shaped roll cage members which are similar to the members 80 and 90, but which include a different configuration at the lower ends in the form of the slots 106 and 108 for the member 100, and 116 and 118 for the member 110. The slots are angled slightly upwardly from their open ends, as shown clearly in FIGS. 8 and 9, and allow the engagement of the slots with the angled upturned edge 24 of the chassis shown in FIG. 1 to be effected by means of these members.

The interconnection of the configuration of the members 100 and 110 of FIGS. 8 and 9 with the elongated roll cage members 50 and 60 is effected in the same manner illustrated in FIG. 6 for the members 80 and 90. In such a case, the upturned slot 101 on the member 100 engages the down facing slot 56 on the member 50, and the downturned slot 105 engages the upward facing slot 66 on the member 60. Similarly, the downward facing slot 111 engages the upward facing slot 58 on the member 50; and the upward facing slot 115 on the member 110 engages the downward facing slot 68 on the member 60. The assembly then has the same appearance as that shown in FIG. 7 incorporating the members 50,60,80 and 90. The slots 106 and 108 on the legs 102 and 104 and the slots 116 and 118 on the legs 112 and 114 then are used to removably secure the roll cage to the chassis 22.

Another alternative, which is not illustrated, for attaching the roll cage to the chassis 22 of the model is to provide the lower ends of the legs of the U-shaped transverse roll cage members, such as 80,90,100 and 110, with a projection to extend through a hole or aperture in the chassis plate 22 for engagement with a spring clip or cotter pin located beneath the chassis. This type of interconnection, however, requires additional parts; whereas the configurations shown in FIGS. 2, 3, 8 and 9 are held in place by the spring action of the arms of the transverse roll cage members 80,90,100 and 110. Consequently, the embodiments shown in FIGS. 2, 3, 8 and 9 are preferable; although a roll cage which employs additional fasteners or connecting members clearly can be used as well as the ones which have been illustrated and described above.

The foregoing description of the preferred embodiment of the invention is to be considered illustrative and not as limiting. Various changes and modifications will occur to those skilled in the art for performing substantially the same function, in substantially the same way, to achieve substantially the same result, without departing from the true scope of the invention as defined in the appended claims.

What is claimed is:

1. A roll cage for a model car or truck having an elongated chassis with a predetermined length and a predetermined width carrying operating components of the model car or truck, the roll cage including in combination:

at least one elongated roll cage member made of flat stock and configured to substantially overlie the length of the chassis over operating components on the chassis;

at least one generally inverted U-shaped roll cage member made of flat stock and configured to substantially overlie the width of the chassis, with a bight portion of the U-shaped roll cage member located over operating components on the chassis;

means for interconnecting the bight portion of the U-shaped roll cage member with the elongated roll cage member to form the roll cage; and means for attaching the roll cage to the chassis.

2. The roll cage according to claim 1 wherein the means for interconnecting the bight portion of the U-shaped roll cage member with the elongated roll cage member comprises mating slots extending partially through each of the elongated roll cage member and the inverted U-shaped roll cage member.

3. The roll cage according to claim 2 wherein the flat stock is metal.

4. A roll cage according to claim 3 wherein the means for attaching the roll cage to the chassis removably attaches the roll cage to the chassis.

5. A roll cage according to claim 4 wherein the configuration of the at least one elongated roll cage member conforms to the inner surface of an outer body portion adapted to be attached to the model car or truck.

6. A roll cage for a model car or truck having an elongated chassis with a predetermined length and a predetermined width carrying operating components of the model car or truck, the roll cage including in combination:

at least one elongated roll cage member configured to substantially overlie the length of the chassis over operating components on the chassis;

at least one generally inverted U-shaped roll cage member configured to substantially overlie the width of the chassis, with a bight portion of the U-shaped roll cage member located over operating components on the chassis;

means comprising mating slots extending partially through each of the elongated roll cage member and the inverted U-shaped roll cage member for interconnecting the bight portion of the U-shaped roll cage member with the elongated roll cage member to form the roll cage; and means for attaching the roll cage to the chassis.

7. A roll cage according to claim 6 wherein the means for attaching the roll cage to the chassis removably attaches the roll cage to the chassis.

8. A roll cage according to claim 6 wherein the configuration of the at least one elongated roll cage member conforms to the inner surface of an outer body portion adapted to be attached to the model car or truck.

9. A roll cage for a model car or truck having an elongated chassis with a predetermined length and a predetermined width carrying operating components of the model car or truck, the roll cage including in combination:

at least one elongated roll cage member configured to substantially overlie the length of the chassis over operating components on the chassis;

at least one generally inverted U-shaped roll cage member configured to substantially overlie the width of the chassis, with a bight portion of the U-shaped roll cage member located over operating components on the chassis;

means for interconnecting the bight portion of the U-shaped roll cage member with the elongated roll cage member to form the roll cage; and means for removably attaching the roll cage to the chassis.

10. A roll cage for a model car or truck having an elongated chassis with a predetermined length and a predetermined width carrying operating components of the model car or truck, the roll cage including in combination:

at least first and second spaced-apart elongated roll cage members made of flat stock material and configured to substantially overlie the length of the chassis over the operating components on the chassis;

at least first and second generally inverted U-shaped roll cage members made of flat stock material and configured to substantially overlie the width of the chassis, with a bight portion of the first and second U-shaped roll cage members located over operating components on the chassis;

means for interconnecting the bight portions of the first and second roll cage members with the spaced-apart first and second elongated roll cage members; and means for attaching the roll cage to the chassis.

11. The roll cage according to claim 10 wherein the first and second elongated roll cage members and the first and second inverted U-shaped roll cage members are made of metal.

12. A roll cage according to claim 11 wherein the means for interconnecting the bight portion of the first and second roll cage members with the first and second elongated roll cage members comprise slip-fit mating slots on the respective roll cage members.

13. The roll cage according to claim 12 wherein the means for attaching the roll cage to the chassis comprises a friction engagement of the legs of the first and second inverted U-shaped roll cage members with the chassis, on opposite sides of the chassis.

14. The roll cage according to claim 13 further including means on at least one of the roll cage members for attaching a body cover portion of a model car thereto.

15. A roll cage for a model car or truck having an elongated chassis with a predetermined length and a predetermined width carrying operating components of the model car or truck, the roll cage including in combination:

at least first and second spaced-apart elongated roll cage members configured to substantially overlie the length of the chassis over the operating components on the chassis;

at least first and second generally inverted U-shaped roll cage members configured to substantially overlie the width of the chassis, with a bight portion of the first and second U-shaped roll cage members located over operating components on the chassis;

means for interconnecting the bight portions of the first and second roll cage members with the spaced-apart first and second elongated roll cage members;

means for attaching the roll cage to the chassis; and means on at least one of the roll cage members for attaching a body cover portion of a model car thereto.

16. A roll cage for a model car or truck having an elongated chassis with a predetermined length and a predetermined width carrying operating components of the model car or truck, the roll cage including in combination:

at least first and second spaced-apart elongated roll cage members configured to substantially overlie the length of the chassis over the operating components on the chassis;

at least first and second generally inverted U-shaped roll cage members configured to substantially overlie the width of the chassis, with a bight portion of the first and second U-shaped roll cage members located over operating components on the chassis;

means comprising slip-fit mating slots on the respective roll cage members for interconnecting the bight portions of the first and second roll cage members with the spaced-apart first and second elongated roll cage members; and means for attaching the roll cage to the chassis.

17. The roll cage according to claim 16 wherein the means for attaching the roll cage to the chassis comprises a friction engagement of legs of the first and second inverted U-shaped roll cage members with the chassis, on opposite sides of the chassis.

18. The roll cage according to claim 16 wherein the means for attaching the roll cage to the chassis removably attaches the roll cage to the chassis.

19. The roll cage according to claim 16 wherein the mating slots on the inverted U-shaped roll cage members are spaced apart to provide a predetermined spacing between the first and second elongated roll cage members, and wherein the slots in the first and second U-shaped roll cage members include one slot extending downwardly from the top of the roll cage member and another slot extending upwardly from the bottom, with the arrangement of the slots in the second U-shaped roll cage member being opposite that of those in the first U-shaped roll cage member, with corresponding slots on the first and second elongated roll cage members extending downwardly and upwardly, respectively, for the first elongated roll cage member and being oppositely oriented on the second elongated roll cage member to provide a rigid interconnection of the first and second elongated roll cage member and the first and second inverted U-shaped roll cage members when all of the slots in the roll cage members are engaged with one another.

* * * * *